United States Patent [19]

Eagen et al.

[11] 4,176,604

[45] Dec. 4, 1979

[54] APPARATUS FOR PRINTING A LABEL ON A WEB

[76] Inventors: Roger D. Eagen, 5639 Humboldt Ave.; Clarence E. Vogel, 5628 Humboldt Ave., both of Minneapolis, Minn. 55419

[21] Appl. No.: 889,222

[22] Filed: Mar. 23, 1978

[51] Int. Cl.[2] ..... B41F 31/24

[52] U.S. Cl. ..... 101/328; 101/219; 101/157; 101/365; 101/105; 401/206; 222/187; 118/260

[58] Field of Search ..... 101/364, 365, 212, 213, 101/327, 328, 335, 253, 103, 106, 155-157, 216, 219; 401/198, 206; 222/187; 118/260

[56] References Cited

U.S. PATENT DOCUMENTS

| | | | |
|---|---|---|---|
| 410,154 | 9/1889 | Dean | 101/364 |
| 890,162 | 6/1908 | Munz | 101/154 |
| 980,454 | 1/1911 | Thomson | 101/365 |
| 1,454,362 | 5/1923 | Winchenbaugh et al. | 118/260 |
| 2,161,943 | 6/1939 | Bane | 101/365 |
| 2,776,620 | 1/1957 | Quimby | 101/328 |
| 3,227,080 | 1/1966 | Hill | 118/260 |
| 4,048,919 | 9/1977 | Woods | 101/157 |

*Primary Examiner*—William Pieprz
*Attorney, Agent, or Firm*—Leo Gregory

[57] ABSTRACT

This invention relates to an apparatus for printing labels in spaced relation on a continuous moving web which apparatus includes a printing roller, a wick supplying ink to the roller and a spring plate member underlying the wick pressing the same against the roller, the improvement herein consisting of the plate member having a multiplicity of spring like fingers at its free end, the individual fingers engage and apply pressure against the underside of the wick for a uniform inking engagement of the wick with the non-uniform printing surface of the printing roller to print uniformly inked labels on the web.

2 Claims, 7 Drawing Figures

APPARATUS FOR PRINTING A LABEL ON A WEB

BACKGROUND OF THE INVENTION

1. Field of the Invention

This invention relates to an apparatus for printing labels on a continuous moving endless web and more particularly makes uniform application of ink to the printing roller.

2. Description of the Prior Art

Prior art printing apparatus appears to embody pressure plates with screw adjustments to control the passage of printing ink through the wick or ink applicator as represented by the U.S. Pat. to Dean et al No. 410,154. This structure does not provide for the uniform action of ink against a non-uniform surface of a printing roller and the improvement present in the invention herein results in making a uniform application of ink to a non-uniform surface for a uniformly inked printed impression.

SUMMARY OF THE INVENTION

The invention herein comprises an apparatus wherein a cellophane or like wrapper for a product is fed as a web for engagement by a printing roller to have labels printed thereon. The web is driven and in turn drives the printing roller. A wick extends from an appropriate reservoir and the leading edge of the wick applies ink to the roller. The printing roller carries as an insert the type or printing plate for printing the label. The type or printing plate is subject to wear and the type or letters of the plate in being subject to wear may not have uniform height and thus results in a non-uniform printing surface area. A pressure plate consisting of having a multiplicity of spring like fingers formed at the free edge of the plate, said fingers apply individual pressure against the underside of the wick, to have said wick uniformly engage and apply ink uniformly against the non-uniform printing surface of the printing roller.

This and other objects and advantages of the invention will be set forth in the following description made in connection with the accompanying drawings in which like reference characters refer to similar parts throughout the several views.

DESCRIPTION OF A PREFERRED EMBODIMENT

Figure 1:
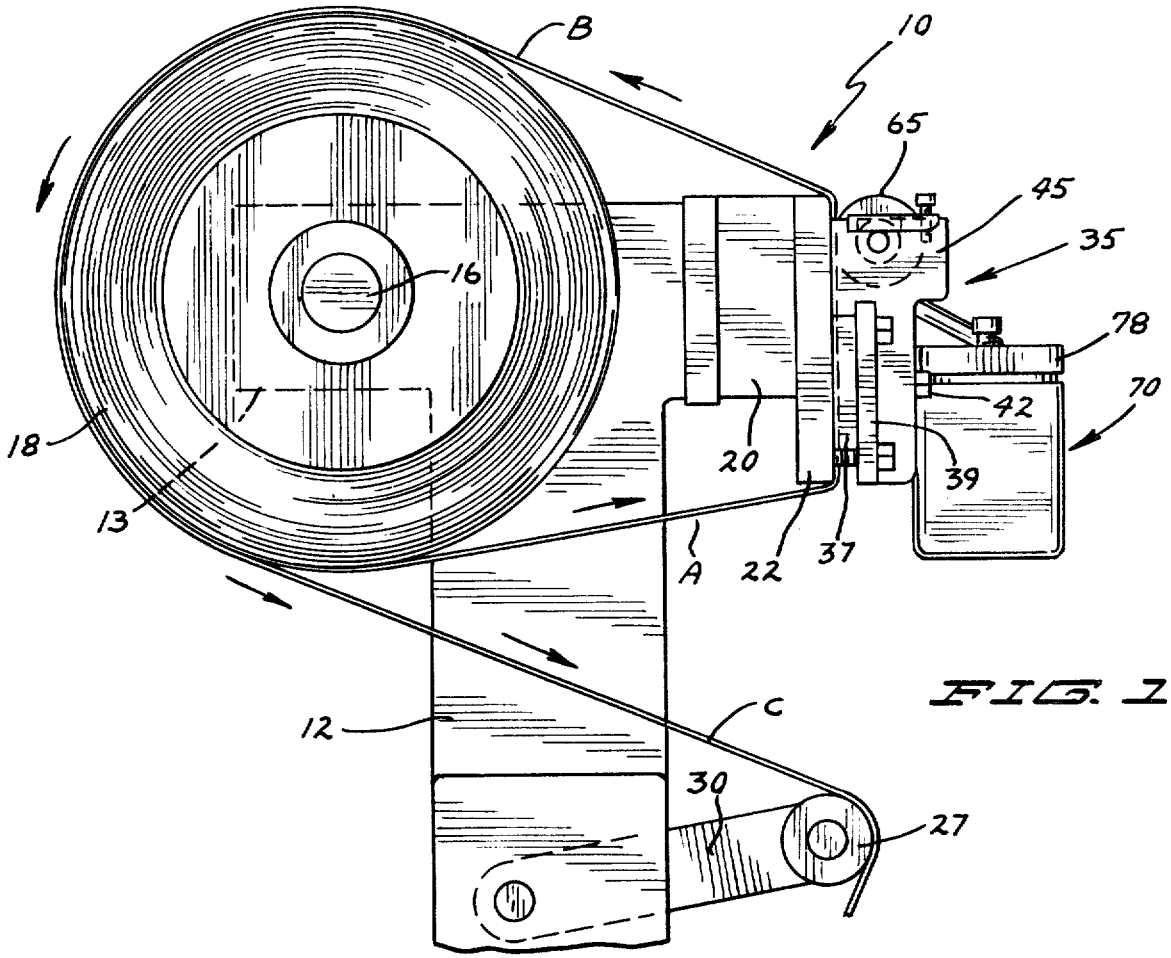
FIG. 1 is a broken view in side elevation showing a portion of the apparatus herein.

Referring to the drawings, the structure comprising the label printing apparatus herein is indicated generally by the reference numeral 10. Shown here is only as much of the supporting structure as is deemed necessary for a full disclosure of the structure comprising the invention herein.

With reference to FIG. 1, shown is a support member 12 upstanding from a base frame member not here shown. A rearward extending stub arm 13 of said support member, indicated in dotted line, is shown supporting in cantilivered suspension at a right angle thereto a shaft 16 journaled therein. Carried in said shaft is a roll or web 18 of a cellophane or like material comprising in flat condition containers or envelopes later to be filled with products and separated from one another after the operation of printing labels thereon has been completed as will be described.

A forward extension 20 of said support member 12 includes horizontally disposed at right angles thereto a face plate 22 substantially rectangular in plan and being secured at the end portion 23 thereof by screws 24 to the end wall 25 of said support member 12. Said face plate has a length greater than the width of said web and is disposed parallel to the axis of said web and said web as will be described rides or passes over the central portion of the outer facing surface 21 of said plate member 22. Said face plate forms a backing support for said web in having labels printed onto the outer facing surface of said web.

It will be noted that of the web the outer layer or run A unwinds from the under side of said web passing under and upwardly over the outer facing surface of said member 22 and then passes over the top of the web as run B and down around the same to pass as run C over the idler roller 27 carried by the arm 30 which is suitably secured to the member 12. Said web then passes over a series of idler and driving rollers through a sequence of steps whereby each envelope is filled with a product and separated from the web, which movement of the web is not here shown.

Said shaft 16 will be equipped with a suitable clutch mechanism not shown to provide a uniform controlled rotation or unwinding of said web.

Said face plate member 22 as will be described has mounted thereon the label printing apparatus 35 to be described which comprises the essential structure of the invention herein.

Mounted in parallel spaced relation to said plate member 22 forwardly of a central portion thereof is a plate member 37 shown having overlying narrow end portion plate members 39 and 40 with screws 42 extending through said end plate members and the end portions of said plate member 37 to secure the same to the plate member 22. Said screws 42 will be such as to secure said plate members 37 in adjustable spaced relation to said plate member 22. The web 18 in passing over said plate member 22 is rearward of the central portion of said plate member 37.

Mounted centrally of said plate member 37 in transverse spaced relation and projecting forwardly thereof are a pair of bearing blocks 45 and 46 being secured to plate member 37 by screws 49 extending through said plate member 37 as shown and journaled therebetween is a shaft 53. Bearing caps 49 and 50 secured by screws 47 overlie said bearing blocks for removal of said shaft 53. Spaced inwardly of said members 45 and 46 by spacing members 52 and carried on said shaft 53 are cylindrical driving rollers 55 and 56 with each being shown here carrying thereabout in spaced relation a pair of friction driving elements, said pairs being indicated as 59 and 62, and the same are shown here in the form of O-rings. Said members 49 and 50 are suitably secured to and rotate with said shaft 53.

Carried centrally of said shaft 53 secured thereto is a conventional printing roller 65 on which the type 66 for printing a label may be changed by removal and insertion in a known manner.

Removably mounted on said plate member 37 in operative relationship with said printing roller 65 is the inking mechanism 70.

Said inking mechanism is carried by a mounting plate 72 having a pair of open ended slots 74 through which are disposed screws 75 which are threaded into said plate member 37 to adjustably hold said mounting plate.

Figure 3:
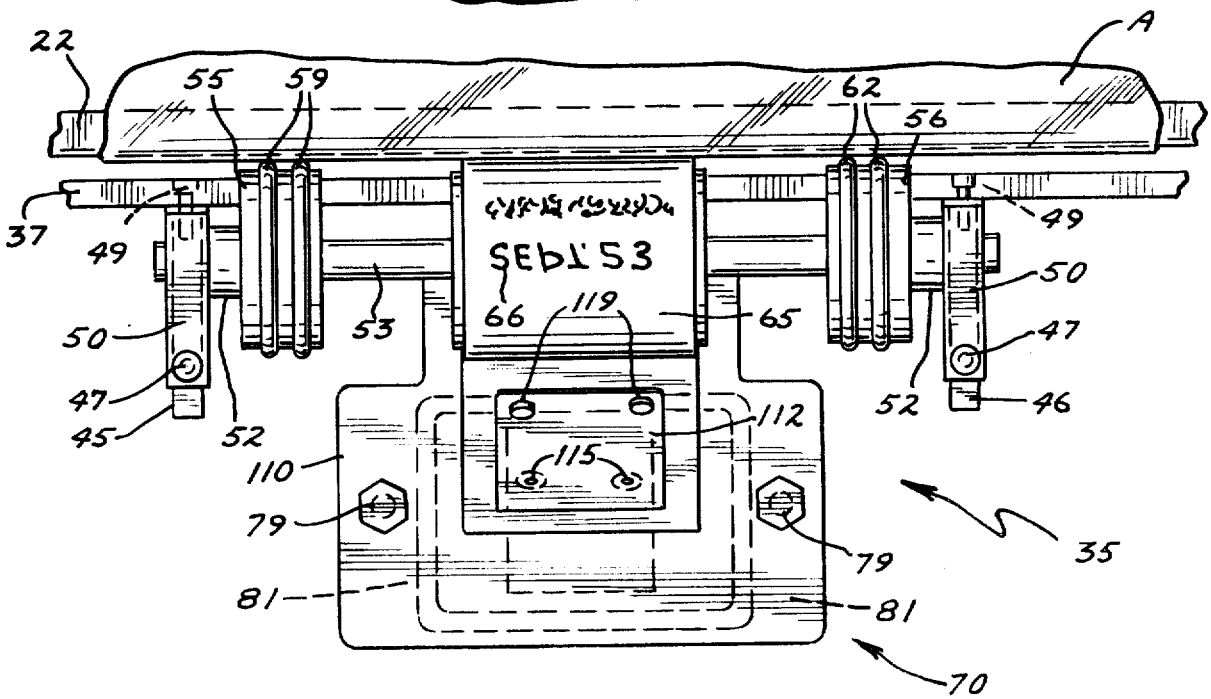
FIG. 3 is a view in horizontal section taken on line 3—3 of FIG. 2 as indicated.
Figure 2:
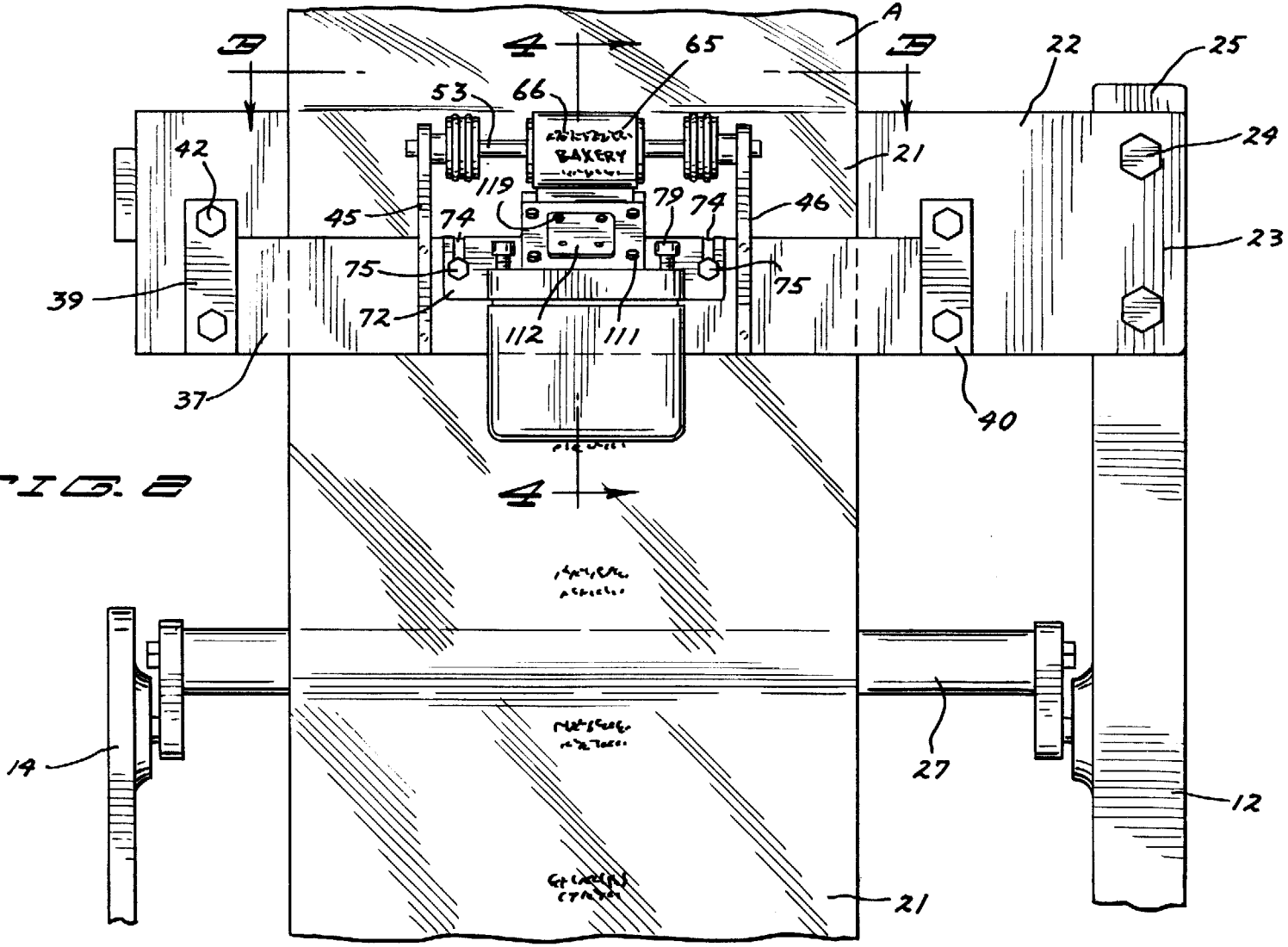
FIG. 2 is a top plan view having portions thereof broken away.

Extending outwardly at right angles to said mounting plate member 72 is a cap plate 78 which holds in a suspended position an ink reservoir or ink well 80 which is here indicated as being rectangular in cross section and has its upper portion disposed into an underlying recess 85 of said cap member and is sealed therein by a sealing ring 86. Said ink well is secured to said cap plate by screws 79 extending through said cap member and being threaded into end flange portions 81 of said ink well as indicated in dotted line in FIG. 3.

Figure 4:
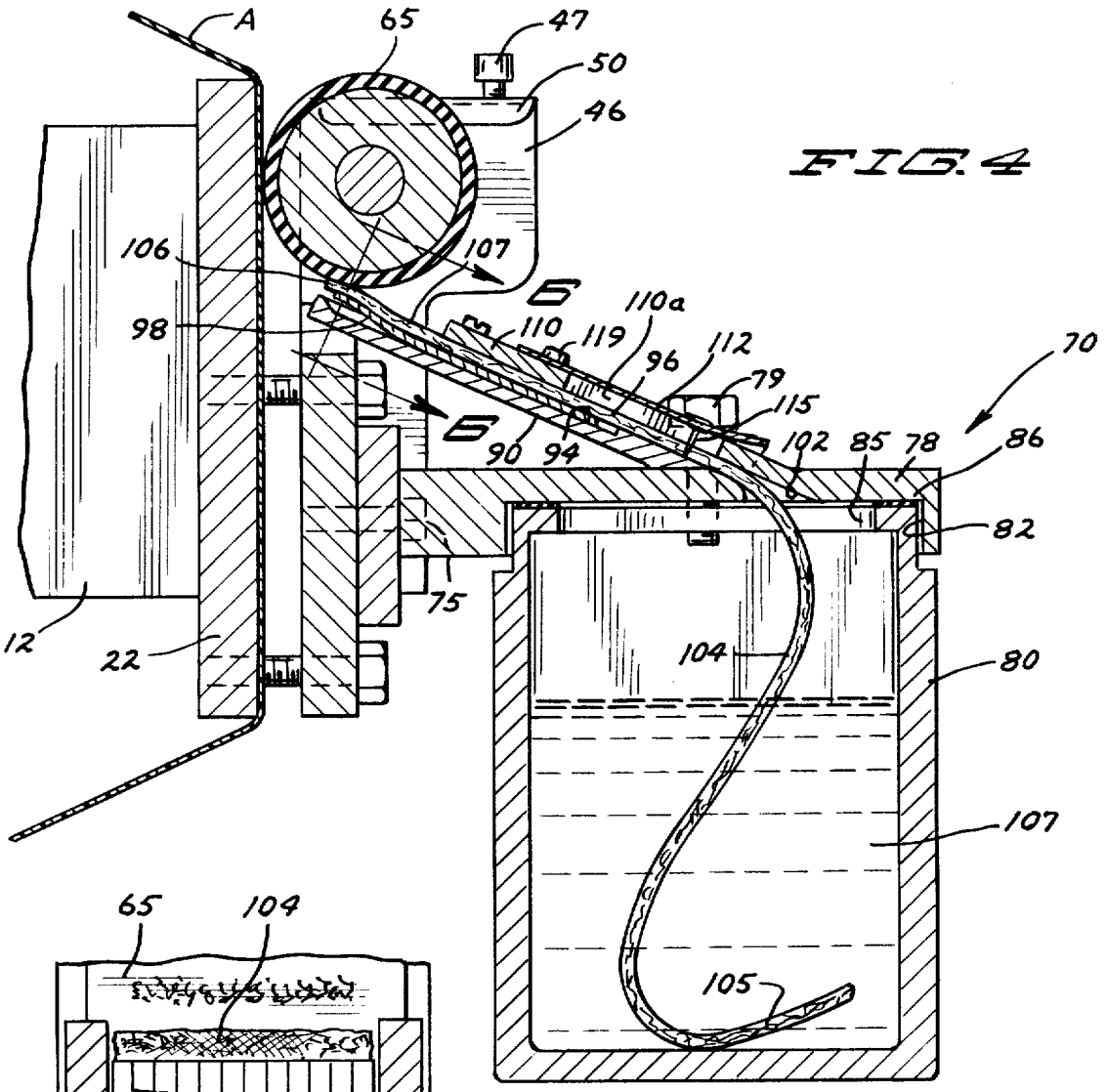
FIG. 4 is a view in vertical section taken on line 4—4 of FIG. 2 as indicated.
Figure 5:
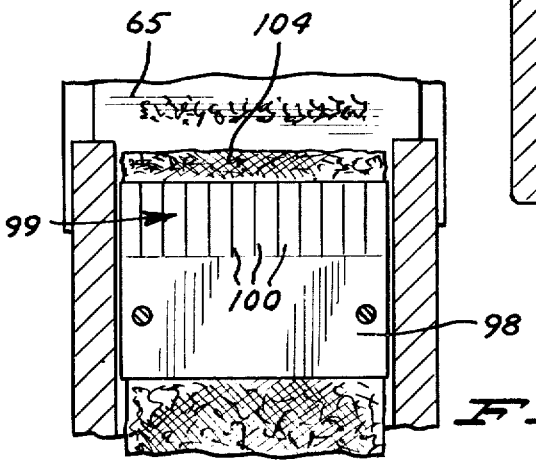
FIG. 5 is a fragmentary view in vertical section taken on line 5—5 of FIG. 4 as indicated.
Figure 6:
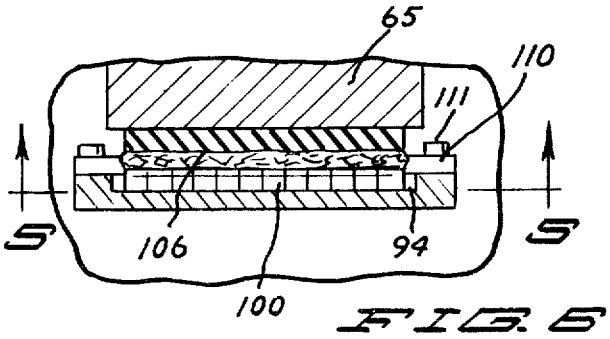
FIG. 6 is a fragmentary view in horizontal section taken on line 6—6 of FIG. 5 as indicated.

Angled upwardly and rearwardly of said cap plate member 78 to a point adjacent the underside of said printing roller 65 is a plate member 90 having a beveled lower end portion 91 permitting its angular placement. Said plate member 90 has a shallow rectangular recess 94 in its upper surface portion 96 into which is disposed a spring pressure plate member 98 having an upwardly angled leading edge portion 99 (FIG. 7) underlying the lower portion of said printing roller 65 as indicated in FIG. 4. The upwardly inclined or upwardly biased leading edge portion of said plate spring member 98 is divided thereacross into a multiplicity of spring teeth 100.

Said plate member 78 has a transverse slot 102 through which is disposed a flat wick 104 having its lower end portion 105 resting in the ink 107 of said ink well 80. The upper end portion of said wick overlies the recess 94 of said plate member 90 and the spring plate member 98 and terminates with its leading edge portion 106 just beyond the free ends 100 of said spring plate member 98 and is positioned to engage and bear against the adjacent surface portion of said printing roller 65 to ink responsive to the pressure of said underlying fingers 100.

Overlying said plate member 90 except for the forward free end portion thereof is plate member 110 secured to said plate member 90 by screws 111 and said screws also secure the spring plate member 99 through its apertures **98*a*. The central upper portion 110*a* of said plate member 110 is open formed as an open slot 110*a* and overlying the same is a flexible plate member 112 secured by screws 119. Extending downwardly through said plate 112 are a pair of spaced pins 115 which secure the wick 104 in position and by binding said plate member upwardly to remove the pins 119** from said wick, said wick may be manually advanced.

OPERATION

Means not here shown will drive said web 18 in having the containers forming said web filled with a product and separated subsequent to the operation of printing labels onto said web. The label printing operation is germaine to the operation herein and is the subject of description herein.

The web in passing over the outer face portion 21 of the face plate 22 engages and rotates the members 59 and 62 carried by the rollers 55 and 56 to rotate the shaft 53 which in turn rotates or drives the printing roller 65.

The printing roller has indicia 66 therein which provides the text comprising the labels printed onto the web and is formed of type elements which of themselves are subject to wear and provide a non-uniform surface. It is essential that there be an equal application of ink to all of the type elements for a uniform impression onto the web 18.

Figure 7:
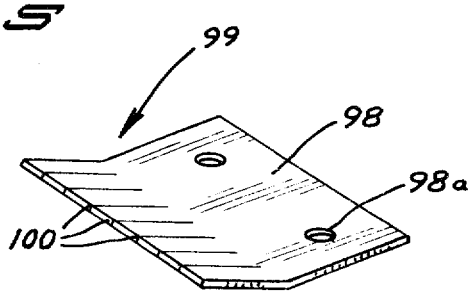
FIG. 7 is a view in perspective showing a detail of structure.

The wick 104 by capillary action transfers ink from the ink well 80 upwardly of itself into engagement with the printing roller 65. At this point is introduced the essential novelty of the invention herein. The spring plate member 98 underlies the free end portion of the wick which engages the printing roller. This plate member is angled upwardly in vertical longitudinal section as indicated in FIG. 7. The upwardly angled portion 99 of said plate member is slit or cut longitudinally to form thereacross a multiplicity of spring or spring like fingers 100, said fingers being biased upwardly to have individual pressure engagement with the underside of said wick adjacent its free end portion 106 as indicated in FIG. 4. The pressure of said individual fingers 100 against the underside of said wick assures a uniform engagement of the wick with each type element and a uniform application of ink onto the face portions of all of said type elements in printing a label onto said web. Thus as the type faces become worn and form a more or less non-uniform printing surface, there is a uniform application of ink therein for a unifrom inked impression onto the web. The web has sufficient compression or resilience to accommodate the non-uniform printing surface for a full inked impression.

The plate member 112 may be raised to lift its pins 115 free of the wick for upward manual adjustable movement of the wick whenever its free end becomes frayed and requires trimming.

The use of the spring member 98 has resulted in very clear even impressioned labels being printed onto the web surface and represents a highly satisfactory appearance and has proved to be very successful in operation.

It will of course be understood that various changes may be made in form, details, arrangement and proportions of the parts without departing from the scope of the invention herein which, generally stated, consists in an apparatus capable of carrying out the objects above set forth, in the parts and combinations of parts disclosed and defined in the appended claims.

What is claimed is:

1. A label printing apparatus for a continuous web having in combination a web formed of an endless strip of separable containers, means supporting said web, a first plate member carried by said means having said web pass thereover, a second plate member, means adjustable securing said second plate member to said first plate member in spaced relation thereto, a printing roller, means supporting said printing roller onto said second plate member in operating engagement with said web, an ink reservoir, means carried by said second plate member supporting said ink reservoir, a wick carried by said last mentioned means from said ink well into operating engagement with said printing roller, a unitary spring plate member underlying said wick, a multiplicity of spring like fingers unitary with and extending from said plate member underlying said wick edge portion engaging said printing roller, and said fingers being individually biased in the direction of said printing roller and individually urge their respective engaged portions of said wick into engagement with said printing roller for uniform application of ink onto a non-uniform surface.

2. A label printing apparatus for a continuous web having in combination a web, a printing roller, means supporting said web in operating engagement with said printing roller, means carried by said last mentioned means supporting an ink reservoir, a wick carried by said last mentioned means from said ink reservoir into operating engagement with said printing roller, a unitary spring plate member underlying said wick adjacent said printing roller, said plate member having an upwardly biased portion bearing against said wick, .

said upwardly biased portion being formed into a multiplicity of individual spring like fingers having their free ends bearing against their respective overlying portions of said wick, whereby said fingers individually apply pressure against said wick across the non-uniform printing elements of said printing roller for a uniform application of ink thereon.

* * * * *